US006792885B1

(12) United States Patent
Peng et al.

(10) Patent No.: US 6,792,885 B1
(45) Date of Patent: Sep. 21, 2004

(54) METHOD FOR MANUFACTURING AN INVISIBLE TRADEMARK ZIPPER

(76) Inventors: Mu Hsun Peng, No. 22, Lane 115, Kuan Yeh W. Rd., Ping Jen City, Tao Yuan Hsien (TW); Chi Cheng Lu, No. 710, Ho Ping Rd., Pa Te City, Tao Yuan Hsien (TW)

( * ) Notice: Subject to any disclaimer, the term of this patent is extended or adjusted under 35 U.S.C. 154(b) by 88 days.

(21) Appl. No.: 10/352,977

(22) Filed: Jan. 29, 2003

(51) Int. Cl.[7] ..... D05B 35/06
(52) U.S. Cl. ..... 112/475.16
(58) Field of Search ..... 112/475.16, 104, 112/113, 470.33, 152, 153, 122, 122.1, 122.3, 128, 129; 29/408, 766, 33.2; 83/56, 331, 469, 905, 936

(56) References Cited

U.S. PATENT DOCUMENTS 4,187,791 A * 2/1980 Moertel ..... 112/475.16
4,441,438 A * 4/1984 Takahashi ..... 112/104
4,628,545 A * 12/1986 Metzler ..... 2/265
6,105,284 A * 8/2000 Wu ..... 38/47
6,430,798 B1 * 8/2002 Ru ..... 29/408

* cited by examiner

*Primary Examiner*—Ismael Izaguirre
(74) *Attorney, Agent, or Firm*—Rosenberg, Klein & Lee

(57) ABSTRACT

A method for manufacturing an invisible trademark zipper comprises (1) transferring a continued yard strip printed thereon with complementary halves of a pattern facing down into a weaving machine; (2) synchronizing two zipper teeth by passing the two zipper teeth through a teeth driving device, thereafter transferring the two zipper teeth together with the continued yard strip into the weaving machine; (3) sewing the two zipper teeth on predetermined positions at two sides of a longitudinal central line of the continued yard strip near the complementary halves by using two sets of needles; (4) using a cutting device to cut the continued yard strip into two symmetric pieces along the longitudinal central line of the continued yard strip; and (5) folding the two foldable fringes of the two zipper strips. The zipper teeth are engaged with each other to completely present the pattern on the two zipper strips.

4 Claims, 9 Drawing Sheets

METHOD FOR MANUFACTURING AN INVISIBLE TRADEMARK ZIPPER

BACKGROUND OF THE INVENTION

1. Field of the Invention

The present invention relates to a method for manufacturing an invisible trademark zipper. More particularly, the present invention relates to a method for manufacturing a trademark zipper capable of precisely presenting trademarks, patterns, characters, or marks thereon when two complementary halves are zipped.

2. Description of the Prior Art

Invisible trademark zipper is known in the art. FIG. 1 illustrates a typical view of manufacturing a prior art invisible trademark zipper. As shown in FIG. 1, patterns, characters, or marks 10, which are divided into two complementary halves 101 and 102, are printed, dyed, or weaved on two sides along the longitudinal central line 201 of the continued yard strip 20. Before transferring the yard strip 20 into a weaving machine (not shown), the yard strip 20 is cut into two symmetric pieces along the central line 201 using a cutting knife 30, thereby forming two zipper strips 202 and 203. Thereafter, the two separated zipper strips 202 and 203 are transferred into the weaving machine. In the weaving machine, two spiral zipper teeth 401 and 403 (both made of Nylon) are weaved onto respective inner fringes of the two separated zipper strips 202 and 203 by the dragging force provided by the weaving machine and two sets of weaving needles 501 and 502. A pull tab (not shown in this figure) is then installed thereon to gear up the two spiral zipper teeth 401 and 403, thereby presenting a complete pattern, character, or mark by combining the two complementary halves 101 and 102 on the respective zipper strips 202 and 203.

However, the above-mentioned prior art method has a drawback. In practice, since the two zipper teeth 401 and 402 are made of Nylon and are spiral, pitch between two adjacent teeth of each of the zipper teeth is not constant. The pitch may be compressed or extended by the outer force because of the flexible nature of the zipper teeth 401 and 402. Further, during the process of weaving the two zipper teeth 401 and 402 onto the zipper strips 202 and 203 by the weaving needles 501 and 502, the dragging force applied on zipper teeth 401 and 402 from the weaving machine deteriorates the inconsistence of the teeth pitch of respective zipper teeth. As shown in FIG. 2, the inconsistence between two zipper teeth results in pattern shift (as indicated by the "K"), which is not pleasing to eye.

Consequently, there is a need to provide an improved method for manufacturing an invisible trademark zipper to solve the above-mentioned problem.

SUMMARY OF THE INVENTION

The main objective of the invention is to provide a method for manufacturing an invisible trademark zipper.

According to the claimed invention, a method for manufacturing an invisible trademark zipper is provided. The method comprises (1) transferring a continued yard strip printed or weaved thereon with complementary halves of a pattern, a character, or a mark facing down into a weaving machine; (2) synchronizing two zipper teeth by passing the two zipper teeth through a teeth driving device by which tooth-by-tooth feeding and consistent teeth pitch can be carried out, thereafter transferring the two zipper teeth together with the continued yard strip into the weaving machine; (3) sewing the two zipper teeth on predetermined positions at two sides of a longitudinal central line of the continued yard strip near the complementary halves of a pattern, a character, or a mark by using two sets of needles; (4) using a cutting device to cut the continued yard strip into two symmetric pieces along the longitudinal central line of the continued yard strip, thereby forming two zipper strips having respective zipper teeth and foldable fringes; and (5) folding the two foldable fringes of the two zipper strips. By folding the two zipper strips and the use of a pull tab, the zipper teeth are engaged with each other to completely present the pattern, character, or mark on the two zipper strips.

Other objects, advantages and novel features of the invention will become more clearly and readily apparent from the following detailed description when taken in conjunction with the accompanying drawings.

DETAILED DESCRIPTION OF THE PREFERRED EMBODIMENT

Figure 1:
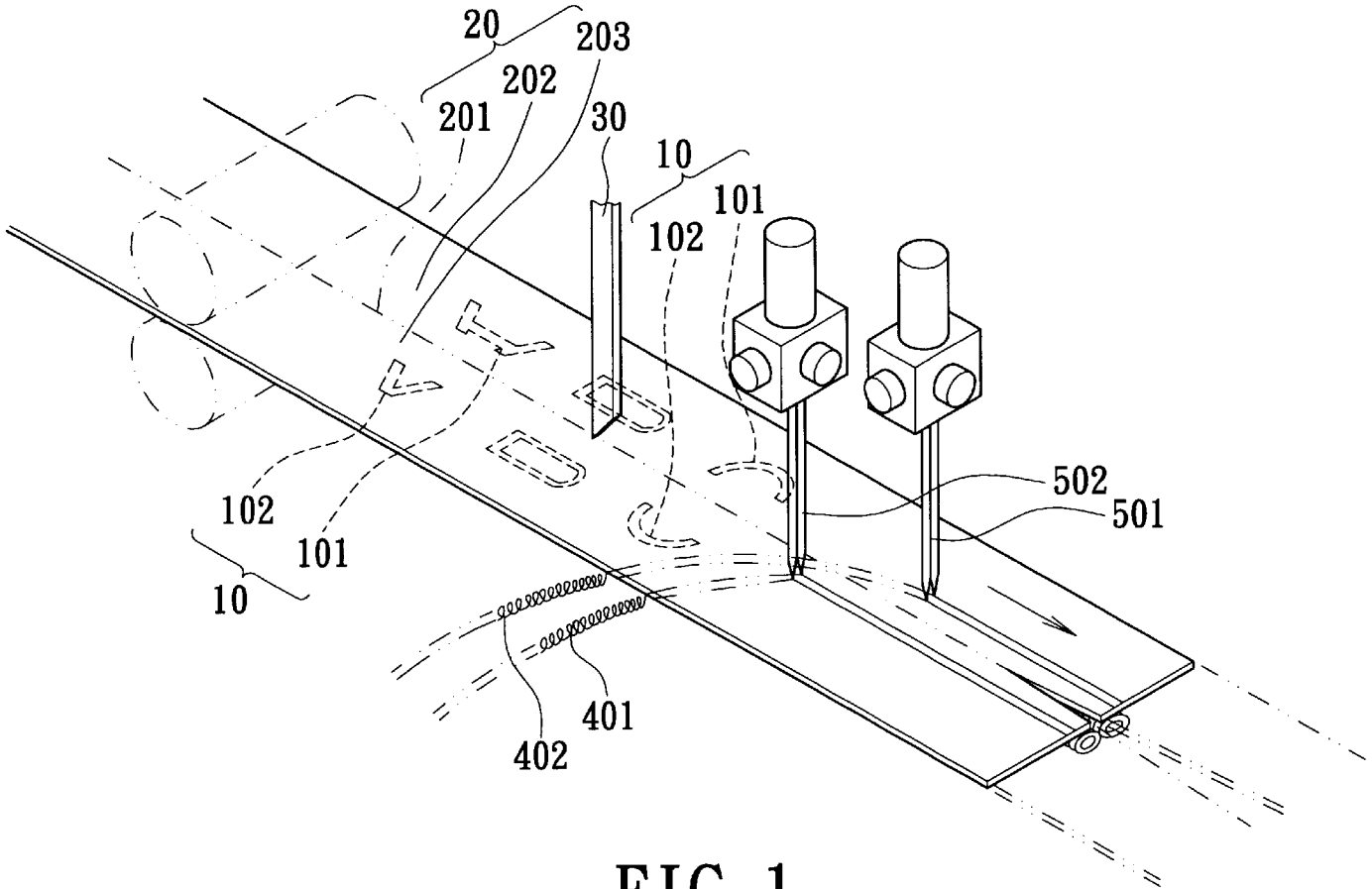
FIG. 1 PRIOR ART
FIG. 1 is a perspective view of the prior art method.
Figure 2:
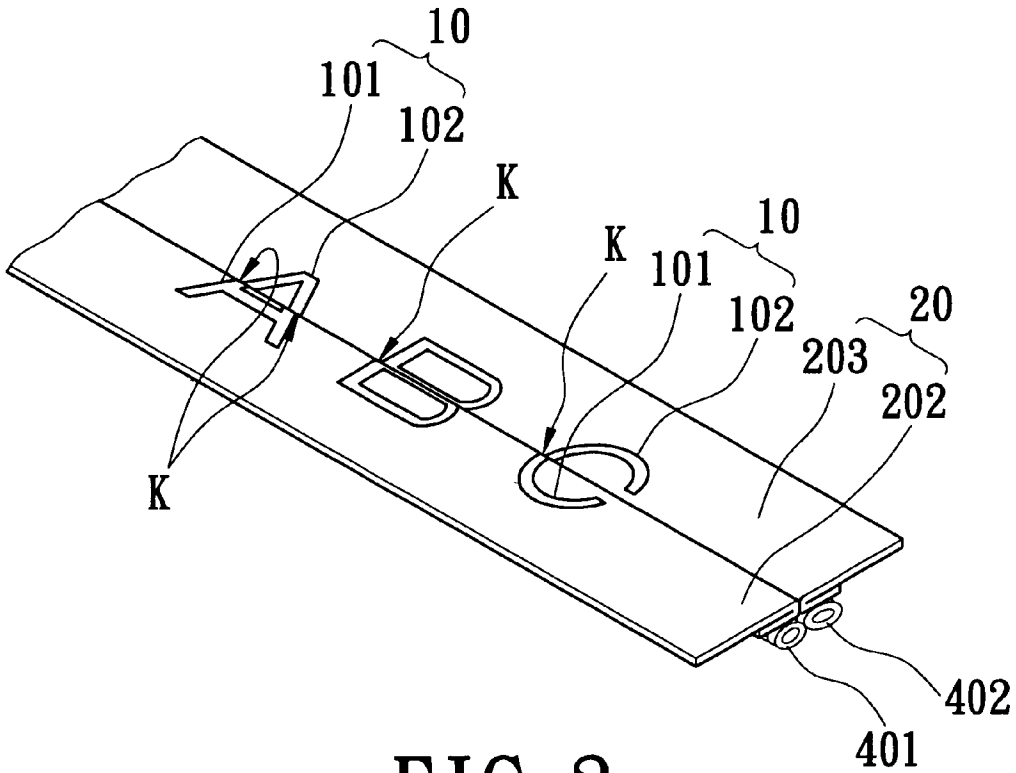
FIG. 2 PRIOR ART
FIG. 2 is a typical view according to the prior art.
Figure 3:
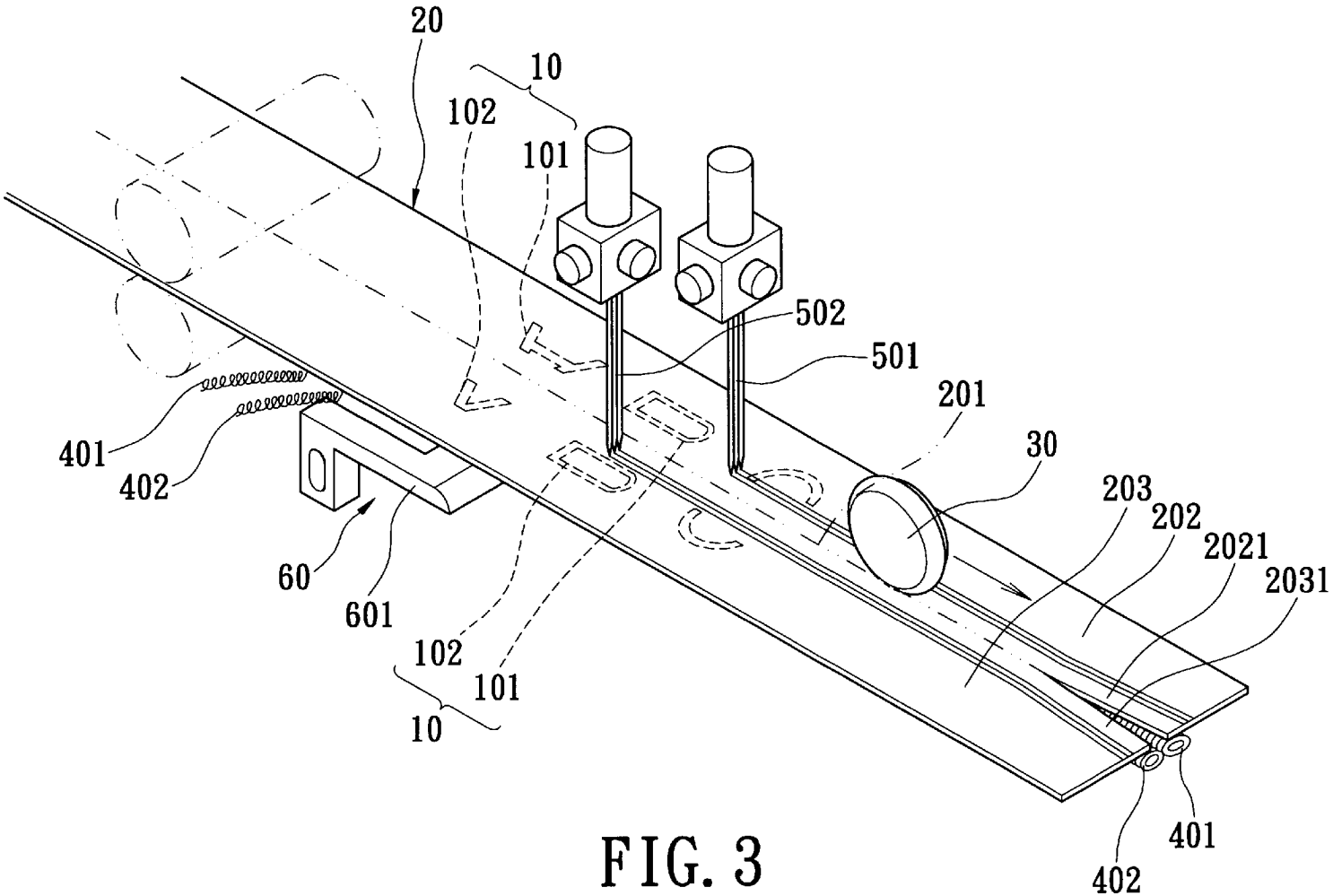
FIG. 3 is a perspective view of the method of this invention.

Please refer to FIG. 3. The present invention pertains to a method for manufacturing an invisible trademark zipper.

Figure 9:
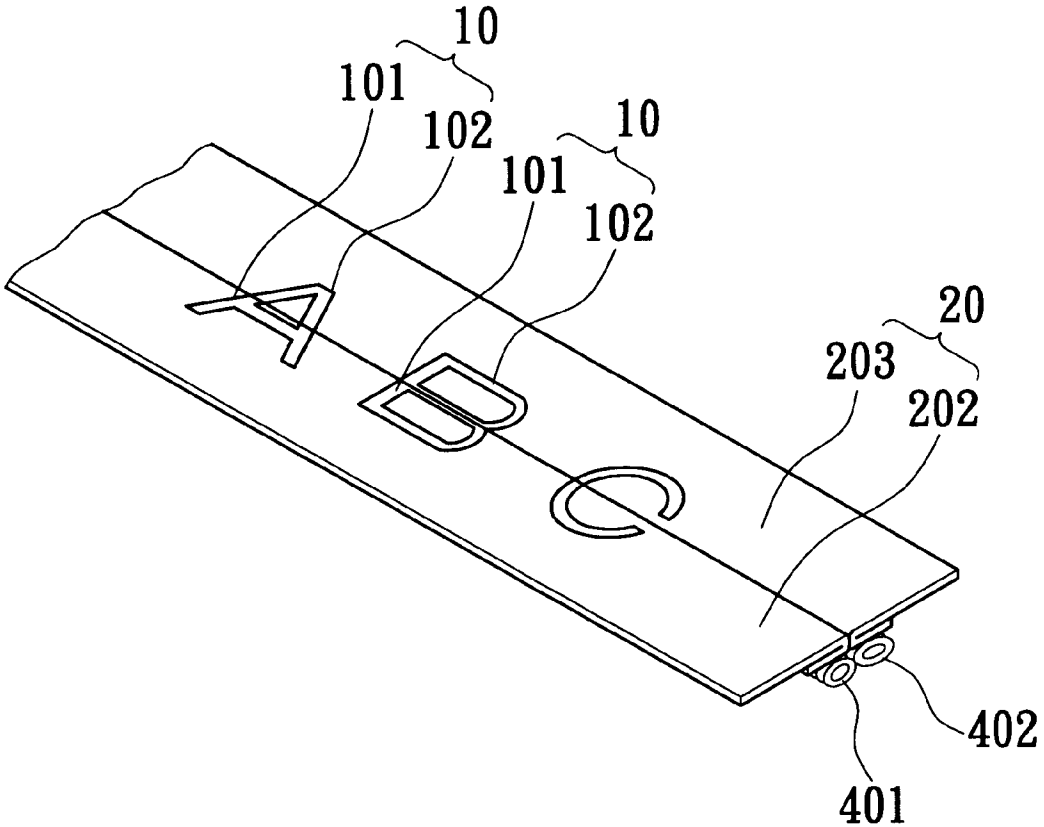
FIG. 9 is a typical view of a complete invisible trademark zipper according to this invention.

As shown in FIG. 3, the continued yard strip 20 having thereon weaved or printed patterns, characters, or marks 10, which were divided into two complementary halves 101 and 102, is transferred into a weaving machine (not shown) in a face down manner, i.e., the weaved or printed patterns, characters, or marks 10 face the ground. In the weaving machine, two zipper teeth 401 and 402 are adjusted by a teeth driving device 60 installed within the weaving machine, such that the teeth pitch of the two zipper teeth 401 and 402 are synchronized. The two zipper teeth 401 and 402 are then sewed on the main surface of the continued yard strip 20 on two sides of the longitudinal central line by two sets of needles 501 and 502. After the two zipper teeth 401 and 402 are sewed on the surface of the continued yard strip 20, the yard strip 20 is transferred to a cutting apparatus and is cut into two symmetric pieces along the longitudinal central line, thereby forming two zipper strips 202 and 203 with respective zipper teeth 401 and 402 and foldable fringes 2021 and 2031. By folding the foldable fringes 2021 and 2031 and the use of a pull tab, as shown in FIG. 9, the complementary halves of patterns, characters, or marks 10 located on respective zipper strips 202 and 203 can present a complete and precise combination of such patterns, characters, or marks 10.

Figure 4:
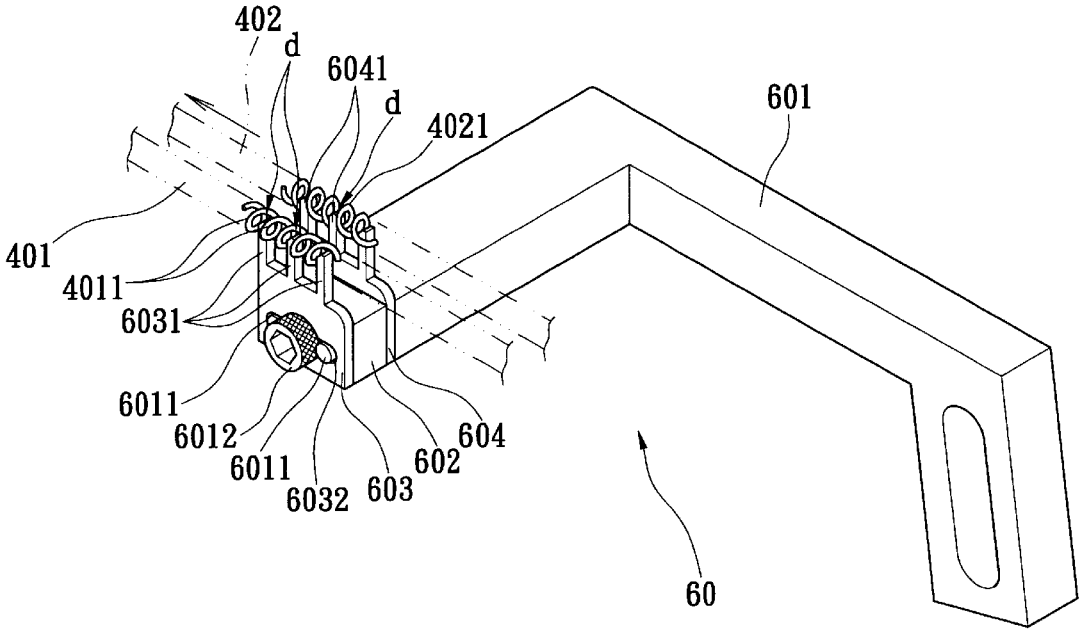
FIG. 4 and FIG. 5 are perspective views of the teeth driving device of this invention.
Figure 5:
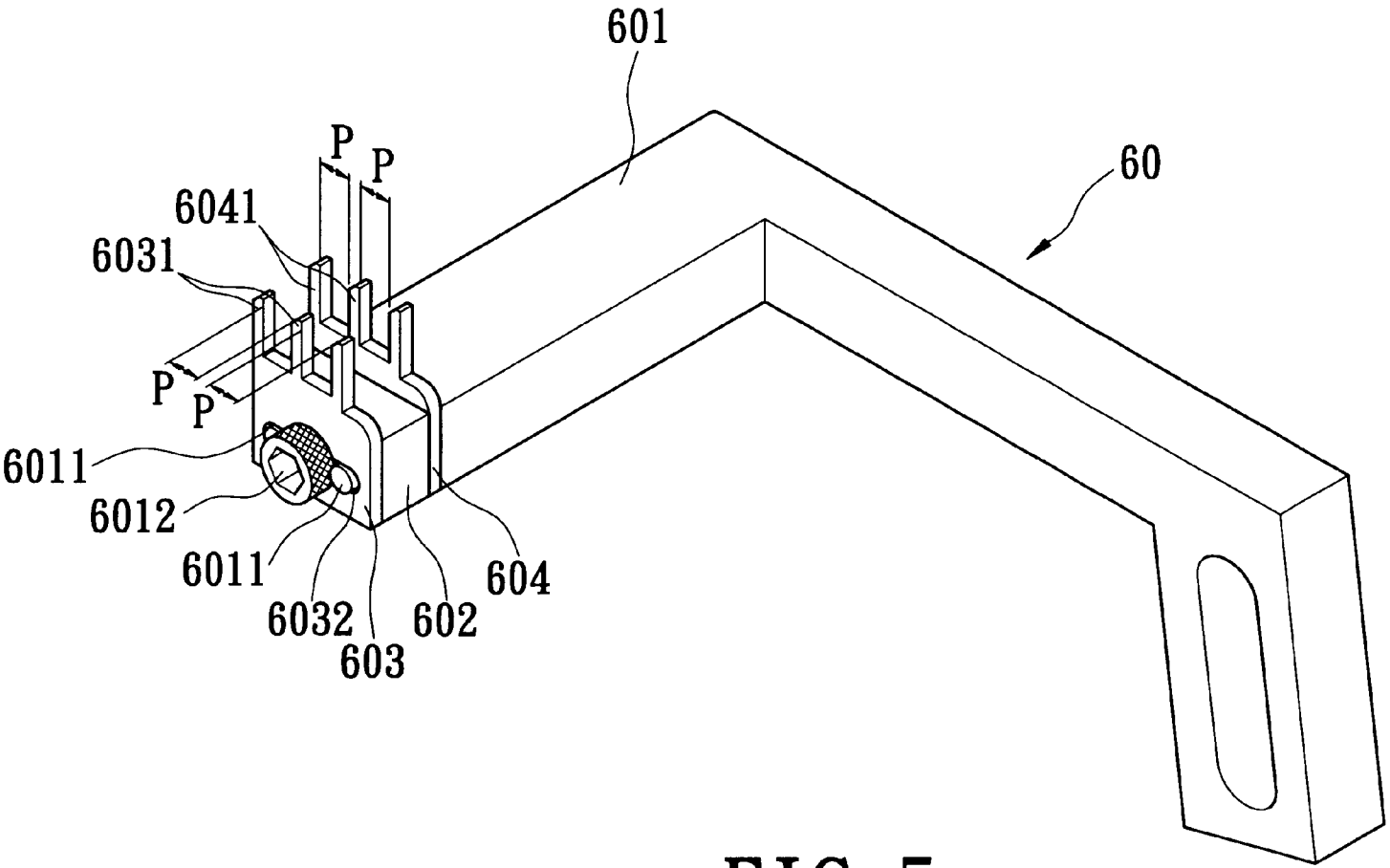
Figure 6:
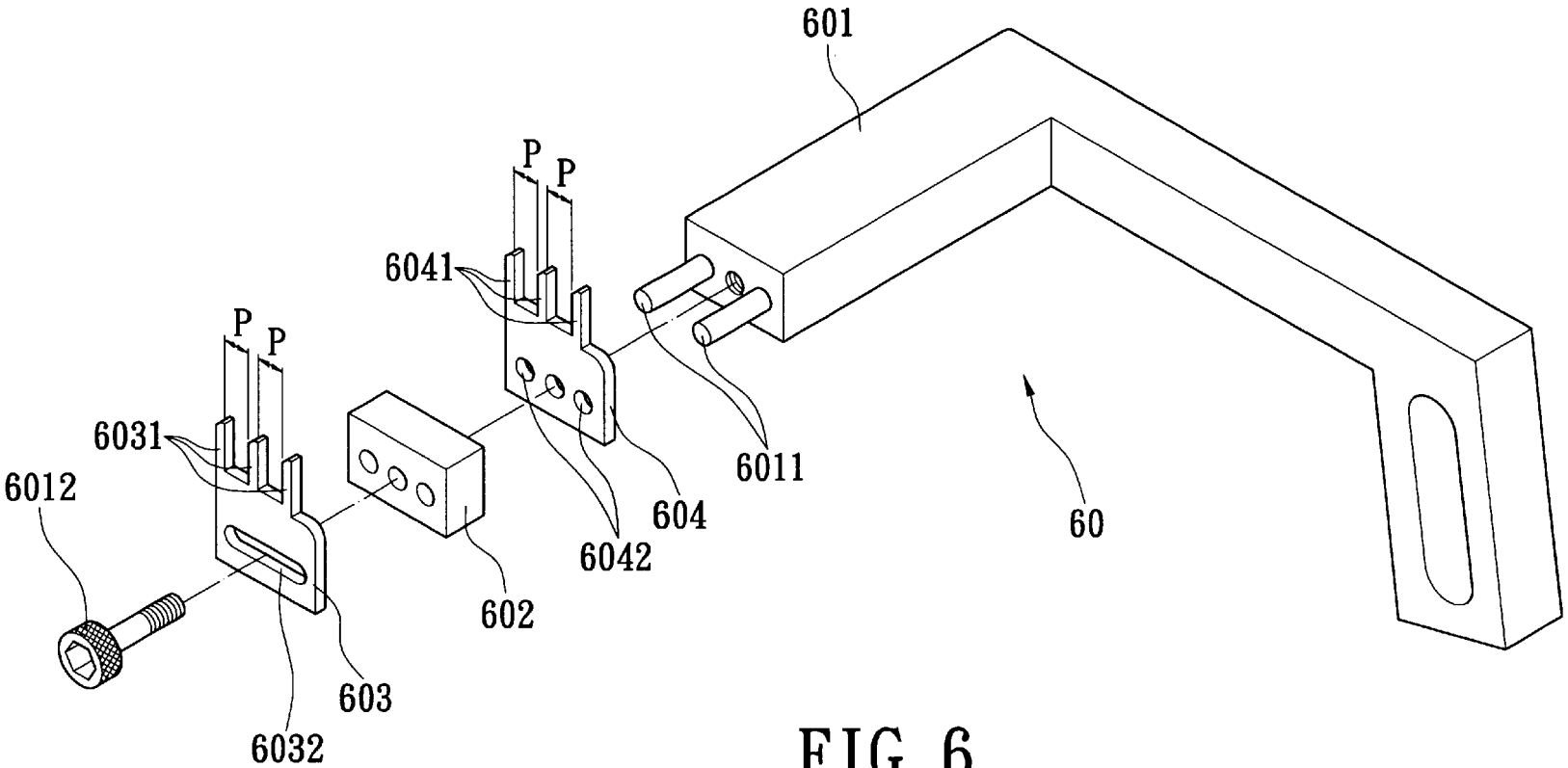
FIG. 6 is an exploded diagram of FIG. 5.

With reference to FIG. 4 to FIG. 6, the teeth driving device 60 is installed in the weaving machine and is synchronized with the descending motion and ascending motion of the needles 501 and 502. The teeth driving device 60 comprises a reciprocating feeding crank 601. Two parallel positioning plates 603 and 604 are installed at one end of the feeding crank 60. The positioning plates 603 and 604 are spaced apart from each other by interposing therein with a spacer 602. As indicated, the positioning plates 603 and 604, and the spacer 602 are fixed in position by a positioning pin 6011 and fastened with a bolt 6012. On each of the two positioning plates 603 and 604, there are provided inserting protrusions 6031 and 6041 having same pitch "P" as the teeth pitch "d" of the zipper teeth 4011 and 4021. The pitches "P" of the inserting protrusions 6031 and 6041 are the same. To assure the stability of the device, positioning pins 6011 of the feeding crank 60 pass through a positioning hole 6042 of the positioning plate 604. The positioning plate 603 has an elongated aperture 6032. The positioning pins 6011 of the feeding crank 60 pass through the aperture 6032. By doing this, forward or backward displacement can be adjusted. The thickness of the spacer 602 is also critical. The distance between the two parallel positioning plates 603 and 604 corresponds to two zipper teeth 401 and 402 sewed on the predetermined positions of the continued yard strip 20, such that the inserting protrusions 6031 and 6041 of the respective positioning plates 603 and 604 are fit to the teeth pitch "d".

It is noted that the pitch "P" of the inserting protrusions 6031 and 6041 of the positioning plates 603 and 604 is fit to at least one of the zipper teeth 4011 and 4021. To minimize the size of the positioning plates 603 and 604 and to maintain the convenience for practicing the device, referring to FIG. 7, preferably, the pitch "P" is set to properly accommodate two zipper teeth 4011 and 4021.

Figure 7:
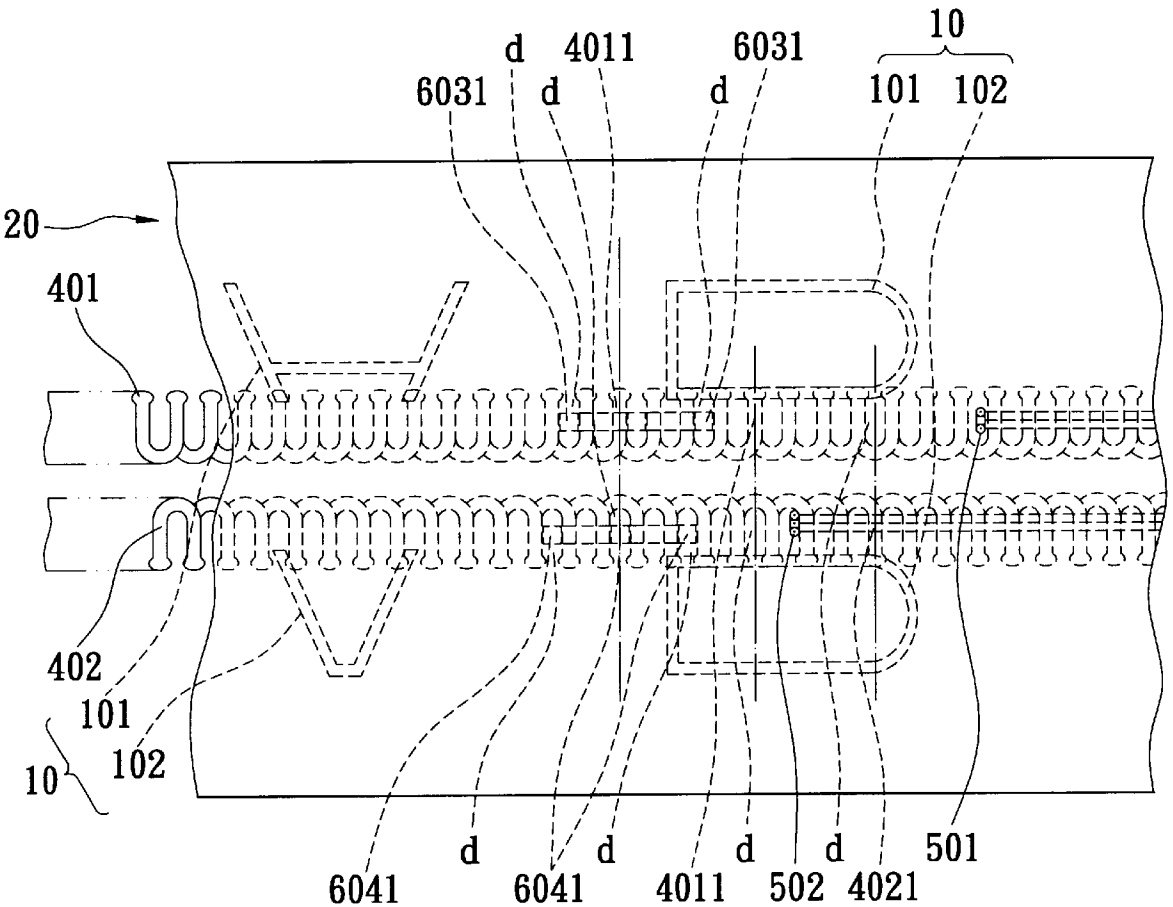
FIG. 7 shows the synchronized feeding of the zipper teeth and the zipper teeth are sewed on the continued yard strip (the rear side of the strip is shown).
Figure 8:
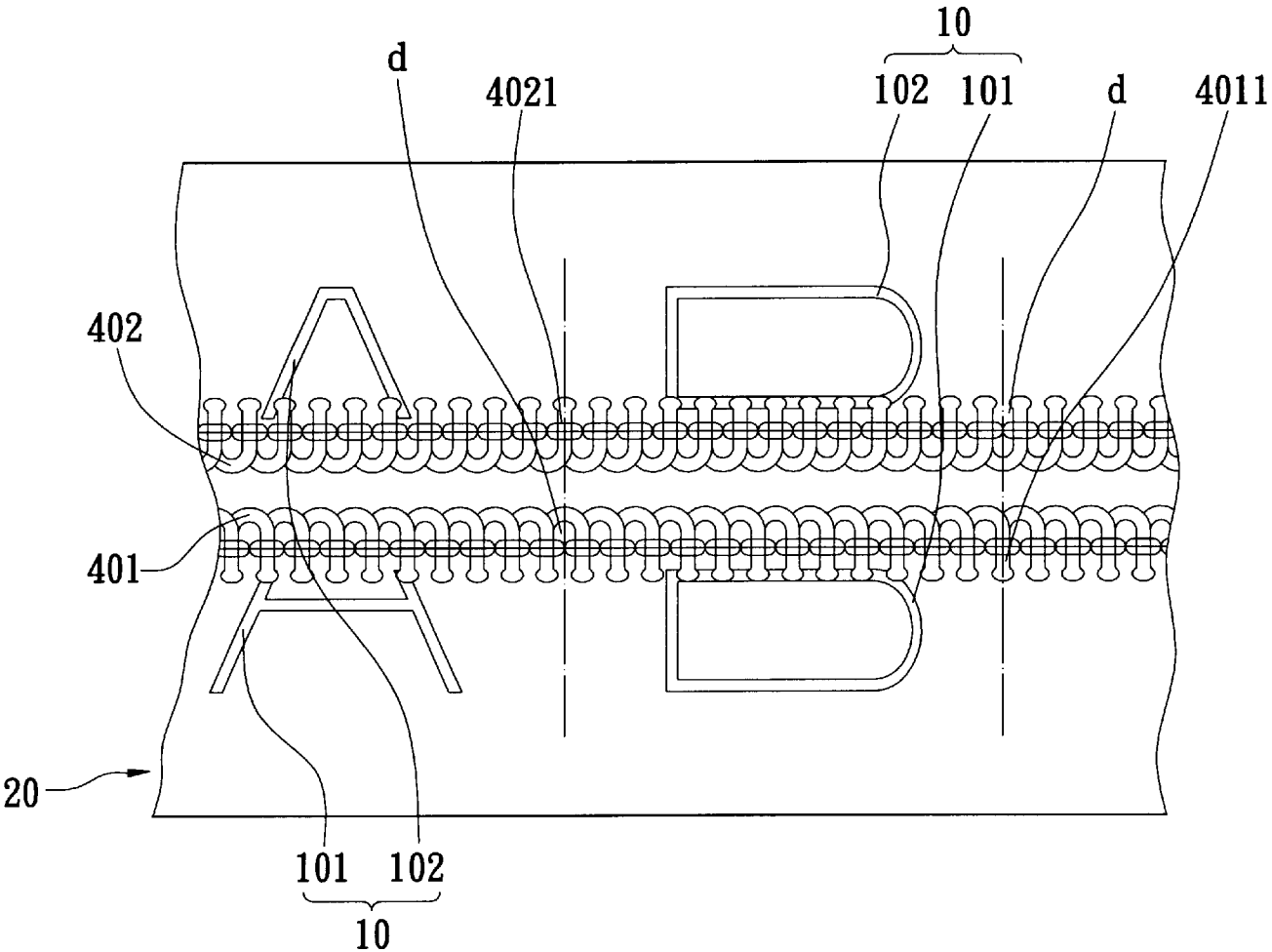
FIG. 8 shows the zipper teeth sewed on the continued yard strip (the front side of the strip is shown).

With reference to FIG. 7 and FIG. 8, when the continued yard strip 20 printed or weaved thereon with complementary halves 101 and 102 of the patterns, characters, or marks 10 facing down is transferred into the weaving machine, the two zipper teeth 401 and 402 first enter the teeth driving device 60, then together with the continued yard strip 20, they are both sent into the weaving machine. Via the inserting protrusions 6031 and 6041 on the respective positioning plates 603 and 604 of the teeth driving device 60, the teeth pitch "d" is maintained by inserting the inserting protrusions 6031 and 6041 into the zipper teeth 401 and 402. Further, since the two positioning plates 603 and 604 are fixed on the feeding crank 601 by using the bolt 6012, a synchronized and reciprocating motion can be carried out. In practice, each of the teeth 4011 and 4012 of the zipper teeth 401 and 402 is constantly pushed by the inserting protrusions 6031 and 6041 of the two positioning plates 603 and 604, such that the zipper teeth 401 and 402 enter the weaving machine tooth by tooth with a consistent and synchronized teeth pitch "d", followed by sewing of the zipper teeth 401 and 402 by the two sets of needles 501 and 502 to solve the inconsistence of teeth pitch due to the dragging force from the weaving machine according to the prior art.

Moreover, since the tooth-by-tooth feeding of the zipper teeth 401 and 402 can be achieved by the two positioning plates 603 and 604 of the teeth driving device 60, the zipper teeth 401 and 402 is transferred into the weaving machine in a consistent teeth pitch "d". Via the elongated aperture 6032 provided on the positioning plate 603, forward or backward adjustment can be freely executed. When the two zipper teeth 401 and 402 is transferred and fed tooth-by-tooth by the positioning plates 603 and 604, one can fine tune the movable positioning plate 603, so that the fed teeth 4011 and 4021 of the zipper teeth 401 and 402 is precisely aligned with the corresponding teeth pitch "d", as indicated in FIG. 7 and FIG. 8. After sewing of the zipper teeth, a cutting device with a cutting knife 30 is used to cut the yard strip 20 into two symmetric pieces along the longitudinal central line, as indicated in FIG. 3. By folding the zipper strips 202 and 203 and the use of a pull tab for engaging two zipper teeth 401 and 402, a complete pattern, character, or mark is presented, as indicated in FIG. 9.

As a whole, the present invention provides a method including first sending the zipper teeth through the teeth driving device 60 to implement a tooth-by-tooth feeding and, at the same time, create a consistent teeth pitch thereof. By fine-tuning the positioning plate 603, corresponding teeth 4011 and 4021 are precisely aligned with corresponding teeth pitch "d". Thereafter, zipper teeth together with the continued yard strip 20 printed or weaved thereon with complementary halves 101 and 102 of a pattern, a character, or a mark 10, they are transferred into the weaving machine. After sewing the zipper teeth by the two sets of needles 501 and 502, the yard strip 20 is cut into two symmetric pieces along the longitudinal central line, thereby forming two zipper strips 202 and 203 having respective zipper teeth 401 and 402 and foldable yard fringe 2021 and 2031. By folding the two zipper strips 202 and 203 and the use of the pull tab, the zipper teeth 401 and 402 are engaged with each other to completely present the pattern, character, or mark on the two zipper strips 202 and 203.

Further, it is understood that the either the positioning plate 603 or the positioning plate 604 is adjustable, not limited to positioning plate 603.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A method for manufacturing an invisible trademark zipper, comprising:

(1) transferring a continued yard strip printed or weaved thereon with complementary halves of a pattern, a character, or a mark facing down into a weaving machine;

(2) synchronizing two zipper teeth by passing the two zipper teeth through a teeth driving device by which tooth-by-tooth feeding and consistent teeth pitch can be carried out, thereafter transferring the two zipper teeth together with the continued yard strip into the weaving machine;

(3) sewing the two zipper teeth on predetermined positions at two sides of a longitudinal central line of the continued yard strip near the complementary halves of a pattern, a character, or a mark by using two sets of needles;

(4) using a cutting device to cut the continued yard strip into two symmetric pieces along the longitudinal central line of the continued yard strip, thereby forming two zipper strips having respective zipper teeth and foldable fringes; and (5) folding the two foldable fringes of the two zipper strips;

wherein by folding the two zipper strips and the use of a pull tab, the zipper teeth are engaged with each other to completely present the pattern, character, or mark on the two zipper strips.

2. The method for manufacturing an invisible trademark zipper as claimed in claim 1 wherein the teeth driving device comprises a reciprocating feeding crank, two parallel positioning plates are installed at one end of the feeding crank, the positioning plates are spaced apart from each other by interposing therein with a spacer, the positioning plates and the spacer are fixed in position by a positioning pin and fastened with a bolt, on each of the two positioning plates, there are provided inserting protrusions having same pitch "P" as the teeth pitch "d" of the zipper teeth.

3. The method for manufacturing an invisible trademark zipper as claimed in claim 2 wherein the distance between the two parallel positioning plates corresponds to two zipper teeth sewed on the predetermined positions of the continued yard strip, such that the inserting protrusions of the respective positioning plates are fit to the teeth pitch "d".

4. The method for manufacturing an invisible trademark zipper as claimed in claim 2 wherein the pitch "P" of the inserting protrusions of the positioning plates is fit to at least one of the zipper teeth.

* * * * *